US010753188B2

(12) United States Patent
Coskuner

(10) Patent No.: US 10,753,188 B2
(45) Date of Patent: Aug. 25, 2020

(54) THERMAL HYDROCARBON RECOVERY METHOD USING CIRCULATION OF SURFACE-HEATED MIXTURE OF LIQUID HYDROCARBON AND WATER

(71) Applicant: Husky Oil Operations Limited, Calgary (CA)

(72) Inventor: Gokhan Coskuner, Calgary (CA)

(73) Assignee: Husky Oil Operations Limited, Calgary (CA)

( * ) Notice: Subject to any disclaimer, the term of this patent is extended or adjusted under 35 U.S.C. 154(b) by 0 days.

(21) Appl. No.: 15/815,912

(22) Filed: Nov. 17, 2017

(65) Prior Publication Data

US 2019/0153833 A1 May 23, 2019

(51) Int. Cl.
*E21B 43/24* (2006.01)
*E21B 43/30* (2006.01)

(52) U.S. Cl.
CPC ..... *E21B 43/24* (2013.01); *E21B 43/305* (2013.01)

(58) Field of Classification Search
CPC ..... E21B 43/24; E21B 43/305
USPC ..... 166/272.4
See application file for complete search history.

(56) References Cited

U.S. PATENT DOCUMENTS 3,768,559 A 10/1973 Allen et al.
4,116,275 A * 9/1978 Butler ..... E21B 36/00 166/303
5,289,881 A * 3/1994 Schuh ..... E21B 36/006 166/303
5,931,230 A * 8/1999 Lesage ..... E21B 43/24 166/303
6,769,486 B2 * 8/2004 Lim ..... C09K 8/58 166/263
7,621,333 B2 11/2009 Marchal
2002/0144818 A1 * 10/2002 Leaute ..... E21B 43/24 166/303
2008/0264635 A1 * 10/2008 Chhina ..... E21B 43/243 166/260
2013/0319663 A1 * 12/2013 Buchanan ..... E21B 43/2406 166/272.3
2014/0251608 A1 9/2014 Gittins et al.
2015/0068750 A1 3/2015 Khaledi et al.
2015/0285047 A1 * 10/2015 Ojagbohunmi ..... E21B 43/24 166/263

* cited by examiner

*Primary Examiner* — Silvana C Runyan

(74) *Attorney, Agent, or Firm* — Gordon & Jacobson, P.C.

(57) ABSTRACT

A method for thermal recovery of hydrocarbon housed in a reservoir comprising injecting a mixture comprising either hydrocarbon and water (for downhole heating) or hydrocarbon and steam (heated at surface) into a wellbore and circulating the heated mixture of hydrocarbon and steam inside the wellbore allowing the heated mixture to increase the temperature of the reservoir and thereby reduce the viscosity of the hydrocarbon within the reservoir. The injection of steam facilitates the delivery of more heat to the reservoir due to the latent heat of steam, compared with circulating heated hydrocarbon alone.

29 Claims, 6 Drawing Sheets

THERMAL HYDROCARBON RECOVERY METHOD USING CIRCULATION OF SURFACE-HEATED MIXTURE OF LIQUID HYDROCARBON AND WATER

FIELD OF THE INVENTION

The present invention relates to hydrocarbon recovery methods, and more specifically to methods that thermally reduce hydrocarbon viscosity allowing the hydrocarbon to flow into a wellbore.

BACKGROUND

It is known in the art of hydrocarbon recovery, and particularly in the recovery of heavy hydrocarbons from subsurface reservoirs, to employ the use of steam or steam-solvent mixtures as an injectant to reduce the viscosity of hydrocarbon housed in a reservoir thus allowing the hydrocarbon to flow to a producing well and thereby be produced to surface. Injected fluids can thermally interact with the hydrocarbon in a manner that allows the hydrocarbon to mobilize and then be produced.

For example, cyclic steam stimulation (CSS) and steam-assisted gravity drainage (SAGD) methods employ steam to mobilize subsurface hydrocarbon such as heavy oil or bitumen.

CSS requires a predetermined amount of steam to be injected into a well drilled into the hydrocarbon deposit, which well is then shut in to allow the steam and heat to soak into the reservoir surrounding the well. This assists the natural reservoir energy by thinning the oil (or, in the case of a steam-solvent injection, also mixing the heavy hydrocarbon with lighter hydrocarbons) so that it will more easily move into the production well. Once the reservoir has been adequately heated, the well can be put into production until the injected heat has been mostly dissipated within the fluids being produced and the surrounding reservoir rock and fluids. This cycle can then be repeated until the natural reservoir pressure has declined to a point that production is uneconomic, or until increased water production occurs.

SAGD involves a pair of horizontal wells that are drilled into a hydrocarbon reservoir. The upper wellbore is typically referred to as the injector well, while the lower wellbore may be referred to as the producer well. In a SAGD hydrocarbon recovery operation, high pressure steam is continuously injected into the upper wellbore to heat the hydrocarbon and reduce its viscosity. The heated hydrocarbon drains into the lower wellbore as a result of gravity. The resulting hydrocarbon in the lower producer wellbore may be pumped to surface.

There are, however, many known drawbacks to using steam during thermal hydrocarbon recovery operations. For example, it has long been recognized that such recovery methods can be costly to implement and operate and require access to significant water resources. Further, in some reservoirs such as Lloydminster-type reservoirs, which are thin heavy oil reservoirs, these conventional steam-based recovery methods generally cannot be employed due to significant heat loss to the overburden and underburden.

Some prior art solutions employ heaters that are positioned in a well which heat the hydrocarbon housed in a reservoir while reducing hydrocarbon viscosity. Heaters typically, however, have issues with reliability and can be difficult to maintain. Furthermore, the use of heaters can be costly if they need to be positioned over a large area.

U.S. Pat. No. 7,621,333 to Marchal addresses some of the drawbacks of the thermal hydrocarbon recovery methods discussed above, by producing hydrocarbon to surface, heating the produced hydrocarbon and then re-injecting the produced hydrocarbon downhole, and circulating it within the wellbore to thermally reduce hydrocarbon viscosity in the reservoir allowing the reservoir hydrocarbon and the re-injected hydrocarbon to be produced together to surface. Marchal does not contemplate, however, the problems associated with adjacent horizontal wellbores that compete for production of the same hydrocarbon resulting in wasted energy during the hydrocarbon recovery process. Furthermore, Marchal would require expensive surface separation technology to generate the hydrocarbon for re-injection.

BRIEF SUMMARY

The present invention seeks to provide a thermal hydrocarbon recovery method that injects a mixture of hydrocarbon and either water or steam, the mixture heated at surface in the case of a hydrocarbon/steam injectant and heated downhole in the case of a hydrocarbon/water injectant, which reduces the viscosity of hydrocarbon housed in a reservoir allowing the reservoir hydrocarbon to flow to a producing well. It is believed that the presence of water/steam in the heated mixture can deliver more heat to the reservoir due to the latent heat of steam and higher heat capacity of water, when compared to re-injection of hydrocarbon alone as in Marchal.

According to a first broad aspect of the present invention, there is provided a thermal hydrocarbon recovery method for producing reservoir hydrocarbon from a reservoir, the method comprising the steps of:

providing a mixture comprising hydrocarbon and water;

heating the mixture, at surface, to form a heated injection mixture comprising heated hydrocarbon and steam;

injecting, from the surface, the injection mixture into at least one wellbore positioned inside the reservoir;

circulating the injection mixture inside the at least one wellbore allowing the injection mixture to increase the temperature of the reservoir and thus reduce the viscosity of the reservoir hydrocarbon, converting at least some of the steam to condensed water;

allowing the reservoir hydrocarbon and reservoir water to flow into the at least one wellbore and mix with the injection mixture; and producing to the surface the injection mixture, the condensed steam, the reservoir hydrocarbon and the reservoir water.

In some exemplary embodiments of the first broad aspect, the hydrocarbon and water (which comprise the mixture) comprise produced hydrocarbon and produced water from a hydrocarbon recovery process. Some exemplary methods may comprise re-injecting such a mixture into the at least one wellbore from which it was initially produced for circulation therein. In addition to the produced water, the water in the injection mixture may comprise additional externally-sourced water, which may be of particular use with so-called "dry wells" that have insufficient reservoir water for the desired volume of water for the injection mixture.

Preferably, the step of producing the injection mixture, the condensed steam, the reservoir hydrocarbon and the reservoir water comprises use of a pump.

In some exemplary embodiments of the first broad aspect, the steps of injecting and producing occur at a flow rate that allows the injection mixture to circulate inside the at least one wellbore while not exiting the at least one wellbore and not substantially entering the reservoir. The step of producing preferably occurs at the same or a higher flow rate than that of the step of injecting.

The mixture may comprise 1 to 50% by volume of water. The mixture may be heated to a temperature that both vaporises the water and is compatible with the surface and wellbore equipment.

In some exemplary embodiments of the first broad aspect, an injection tube, provided inside the at least one wellbore, is used for injecting the injection mixture into the at least one wellbore. Preferably, the injection tube is insulated so that a minimal amount of heat is lost between the surface and a delivery point in the reservoir.

In some exemplary embodiments of the first broad aspect, a production tube, provided inside the at least one wellbore, is used for producing the injection mixture, the condensed steam, the reservoir hydrocarbon and the reservoir water.

Where a production tube is employed, it is preferable that a pump is provided, coupled with the production tube of the at least one wellbore, for pumping the injection mixture, the condensed steam, the reservoir hydrocarbon and the reservoir water into the production tube allowing the injection mixture, the condensed steam, the reservoir hydrocarbon and the reservoir water to be produced to the surface.

According to a second broad aspect of the present invention, there is provided a thermal hydrocarbon recovery method for producing reservoir hydrocarbon from a reservoir, the method comprising the steps of:

providing a mixture comprising hydrocarbon and water;

heating the mixture, at surface, to form a heated injection mixture comprising heated hydrocarbon and steam;

injecting, from the surface, the injection mixture into at least one horizontal wellbore positioned inside the reservoir;

circulating the injection mixture inside the at least one horizontal wellbore allowing the injection mixture to increase the temperature of the reservoir and thus reduce the viscosity of the reservoir hydrocarbon, converting at least some of the steam to condensed water;

allowing the reservoir hydrocarbon and reservoir water to flow into the at least one horizontal wellbore and mix with the injection mixture; and producing to the surface the injection mixture, the condensed steam, the reservoir hydrocarbon and the reservoir water.

In some exemplary embodiments of the second broad aspect, the hydrocarbon and the water comprising the mixture comprise produced hydrocarbon and produced water from a hydrocarbon recovery process. Some exemplary methods may comprise re-injecting such a mixture into the at least one horizontal wellbore from which it was initially produced for circulation therein. In addition to the produced water, the water in the injection mixture may comprise additional externally-sourced water, which may be of particular use with so-called "dry wells" that have insufficient reservoir water for the desired volume of water for the injection mixture.

In some embodiments, the step of producing the injection mixture, the condensed steam, the reservoir hydrocarbon and the reservoir water comprises use of a pump.

In some exemplary embodiments of the second broad aspect, the steps of injecting and producing occur at a flow rate that allows the injection mixture to circulate inside the at least one horizontal wellbore while not exiting the at least one horizontal wellbore and not substantially entering the reservoir. The step of producing preferably occurs at the same or a higher flow rate than that of the step of injecting. The steps of injecting and producing may occur at a flow rate of 20 to 25 m3/d for a 1000 m long horizontal well.

The mixture may comprise 1 to 50% by volume of water. The mixture may be heated to a temperature that both vaporises the water and is compatible with the surface and wellbore equipment.

The injection mixture is preferably injected into a toe region of the at least one horizontal wellbore. In some exemplary embodiments of the second broad aspect, an injection tube, provided inside the at least one horizontal wellbore, is used for injecting the injection mixture into the at least one horizontal wellbore. The injection tube preferably terminates at a toe region of the at least one horizontal wellbore. Preferably, the injection tube is insulated so that a minimal amount of heat is lost from the injection mixture between the surface and a delivery point in the reservoir.

The injection mixture, the condensed steam, the reservoir hydrocarbon and the reservoir water are preferably produced from a heel region of the at least one horizontal wellbore. In some exemplary embodiments of the second broad aspect, a production tube, provided inside the at least one wellbore, is used for producing the injection mixture, the condensed steam, the reservoir hydrocarbon and the reservoir water. Preferably, the production tube terminates at the heel region of the at least one horizontal wellbore.

It is preferable that a pump is provided, coupled with the production tube of the at least one horizontal wellbore, for pumping the injection mixture, the condensed steam, the reservoir hydrocarbon and the reservoir water into the production tube allowing the injection mixture, the condensed steam, the reservoir hydrocarbon and the reservoir water to be produced to the surface.

In some exemplary embodiments of the second broad aspect, the at least one horizontal wellbore comprises a plurality of substantially parallel horizontal wellbores. Preferably, each of the plurality of substantially parallel horizontal wellbores is drilled in an alternating direction from an adjacent horizontal wellbore from the plurality of substantially parallel horizontal wellbores.

According to a third broad aspect of the present invention, there is provided a thermal hydrocarbon recovery method for producing reservoir hydrocarbon from a reservoir, the method comprising the steps of:

providing a mixture comprising hydrocarbon and water;

heating the mixture, at surface, to form a heated injection mixture comprising heated hydrocarbon and steam;

injecting, from the surface, the injection mixture into at least one horizontal wellbore positioned inside the reservoir, wherein an injection tube, provided inside the at least one horizontal wellbore and terminating at a toe region of the at least one horizontal wellbore, is used for injecting the injection mixture into the toe region of the at least one horizontal wellbore;

circulating the injection mixture, through an annulus of the at least one horizontal wellbore, towards a heel region of the at least one horizontal wellbore, inside the at least one horizontal wellbore allowing the injection mixture to increase the temperature of the reservoir and thus reduce the viscosity of the reservoir hydrocarbon, converting at least some of the steam to condensed water;

allowing the reservoir hydrocarbon and reservoir water to flow into the at least one horizontal wellbore and mix with the injection mixture; and producing to the surface the injection mixture, the condensed steam, the reservoir hydrocarbon and the reservoir water, wherein a production tube, provided inside the at least one horizontal wellbore and terminating at the heel portion of the at least one horizontal wellbore, is used for producing the injection mixture, the condensed steam, the reservoir hydrocarbon and the reservoir water.

According to a fourth broad aspect of the present invention, there is provided a thermal hydrocarbon recovery method for producing reservoir hydrocarbon from a reservoir, the method comprising the steps of:

providing a mixture comprising hydrocarbon and water;

injecting, from the surface, the mixture into at least one wellbore positioned inside the reservoir;

heating the mixture, in the at least one wellbore, to form a heated mixture comprising heated hydrocarbon and steam;

circulating the heated mixture inside the at least one wellbore allowing the heated mixture to increase the temperature of the reservoir and thus reduce the viscosity of the reservoir hydrocarbon, converting at least some of the steam to condensed water;

allowing the reservoir hydrocarbon and reservoir water to flow into the at least one wellbore and mix with the heated mixture; and producing to the surface the heated mixture, the condensed steam, the reservoir hydrocarbon and the reservoir water.

In some exemplary embodiments of the fourth broad aspect, the step of heating the mixture comprises heating the mixture with a downhole heater. The heater may be a resistive heater or an RF or microwave based heater.

A detailed description of exemplary embodiments of the present invention is given in the following. It is to be understood, however, that the invention is not to be construed as being limited to these embodiments. The exemplary embodiments are directed to a particular application of the present invention, while it will be clear to those skilled in the art that the present invention has applicability beyond the exemplary embodiments set forth herein.

BRIEF DESCRIPTION OF THE DRAWINGS

In the accompanying drawings, which illustrate exemplary embodiments of the present invention.

Exemplary embodiments of the present invention will now be described with reference to the accompanying drawings.

DETAILED DESCRIPTION OF THE EXEMPLARY EMBODIMENTS

Throughout the following description specific details are set forth in order to provide a more thorough understanding to persons skilled in the art. However, well known elements may not have been shown or described in detail to avoid unnecessarily obscuring the disclosure. The following description is not intended to be exhaustive or to limit the invention to the precise form of any exemplary embodiment. Accordingly, the description and drawings are to be regarded and interpreted in an illustrative, rather than a restrictive, sense.

The present invention is directed to methods for thermal recovery of reservoir hydrocarbon housed in a reservoir, comprising injecting a mixture of either hydrocarbon and water (with heating downhole) or heated hydrocarbon and steam (with heating at surface) into a wellbore and then allowing circulation of the injection mixture inside the wellbore. This allows the injection mixture to increase the temperature of the reservoir and reduce the viscosity of the reservoir hydrocarbon within the reservoir, allowing the reservoir hydrocarbon and reservoir water to flow to the wellbore and mix with the injection mixture. The injection mixture, condensed steam (i.e., water) resulting from heat loss from the steam in the injection mixture, the reservoir hydrocarbon and the reservoir water can subsequently be produced to the surface by means known to a person skilled in the art. In some exemplary embodiments of the present invention, at least a portion of the injection mixture and the reservoir hydrocarbon/water, that was produced to the surface, is then re-injected (with heating again downhole or at surface) back into the wellbore and allowed to circulate inside the wellbore, allowing thermal recovery of additional reservoir hydrocarbon and water housed in the reservoir.

Figure 1:
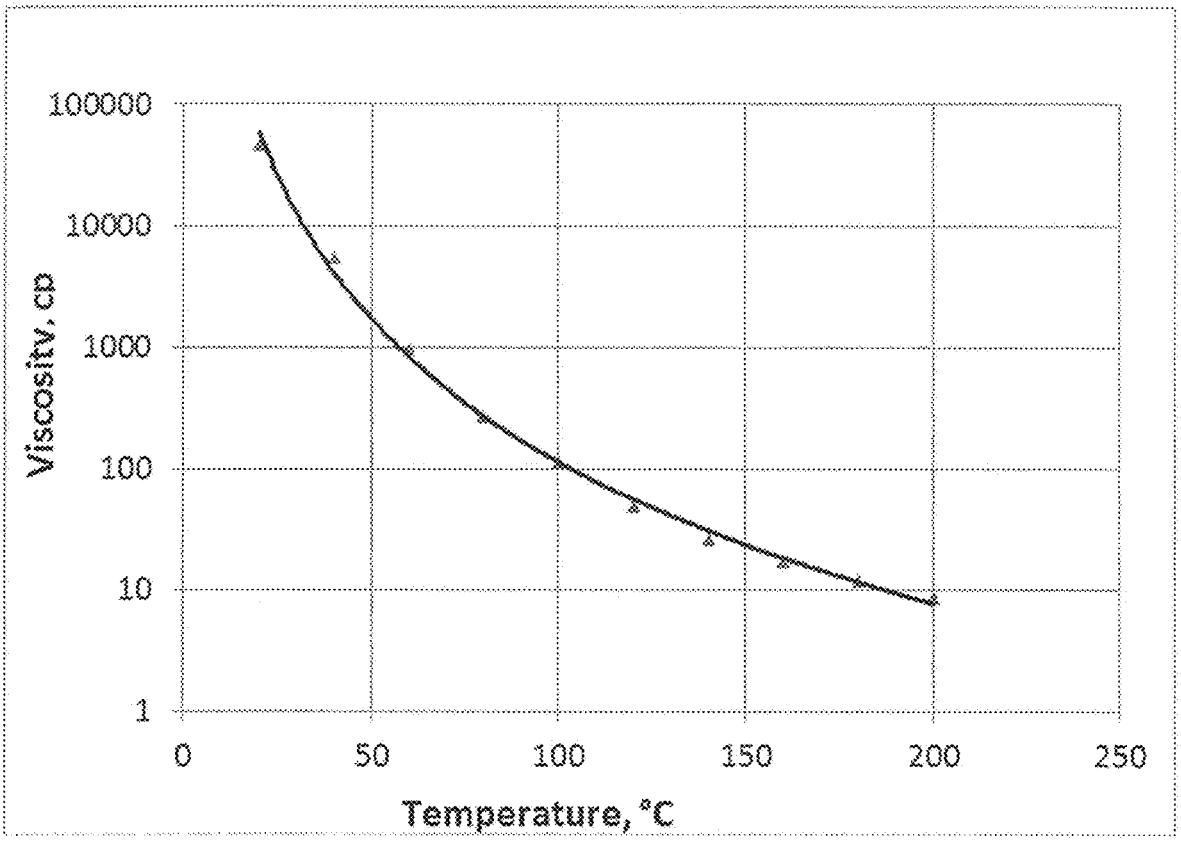
FIG. 1 is a graph illustrating the relationship between hydrocarbon viscosity and temperature.

It is known to those skilled in the art that hydrocarbon from certain reservoirs at standard conditions (i.e., 20 degrees C.) have viscosities of approximately 45,000 cp. However, at 40 degrees C. the same hydrocarbon has a reduced viscosity of approximately 5,000 cp. The relationship between temperature and hydrocarbon viscosity is illustrated in FIG. 1. The present invention involves taking advantage of this relationship by injecting a heated mixture into a wellbore and allowing the injected fluid to heat up portions of a reservoir and the hydrocarbon housed therein. Production rates increase in some proportion with hydrocarbon viscosity reduction. The heated mixture may comprise reservoir hydrocarbon and reservoir water previously produced from the wellbore, and subsequently used as a re-injectant to heat the reservoir and allow for production of further reservoir hydrocarbon and reservoir water. If an insufficient amount of reservoir water was previously produced from the wellbore, the injected heated mixture may comprise additional externally-sourced water that is added at surface prior to heating and injection.

Figure 2A:
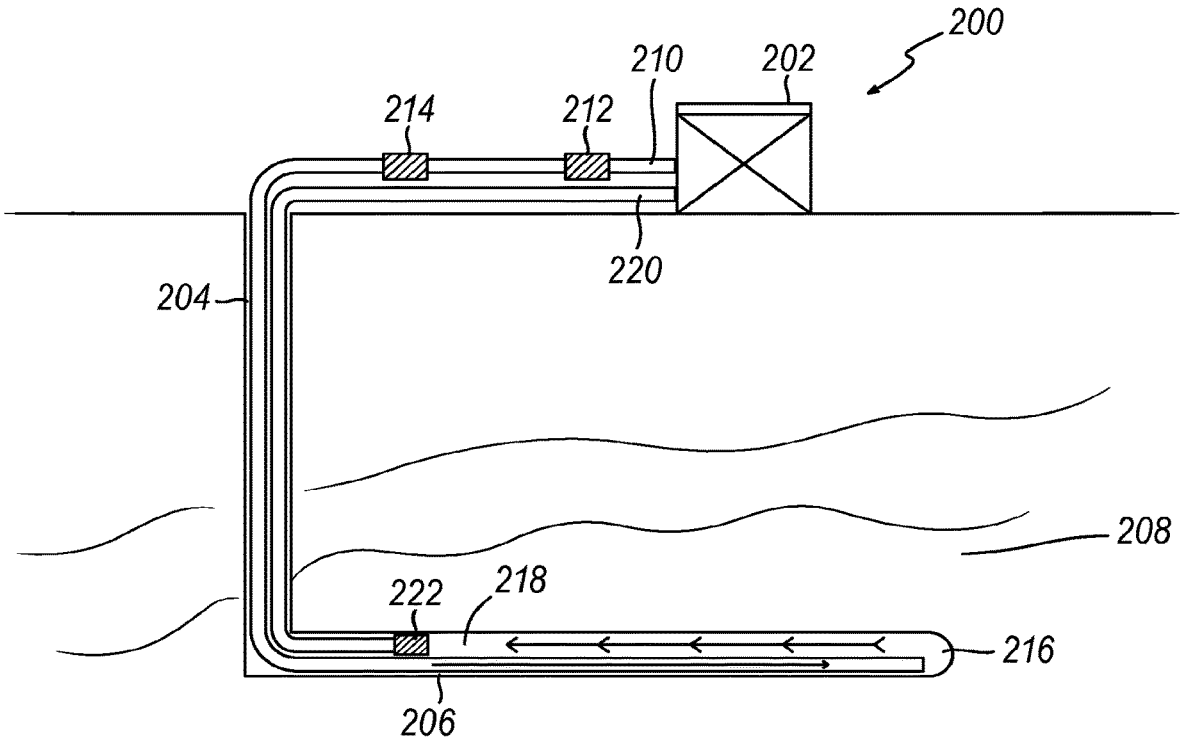
FIG. 2*a* is a simplified schematic view of a first exemplary embodiment.

Turning to FIG. 2*a*, a first embodiment of the present invention is illustrated. A system 200 is provided that allows a mixture comprising hydrocarbon and water, stored in a tank 202, to be heated and injected into a wellbore 204 that comprises a horizontal wellbore 206 that passes through a hydrocarbon-containing reservoir 208.

The mixture comprises 1 to 50% by volume of water in this exemplary embodiment, although the skilled person would be able to determine other appropriate mixtures for other applications of the present invention. The mixture, in this embodiment, comprises reservoir hydrocarbon and reservoir water produced using a hydrocarbon recovery process.

As shown in FIG. 2*a*, the mixture is injected through an injection tube 210 provided inside the horizontal wellbore 206 that is coupled to the storage tank 202. The injection tube 210 terminates at a toe region 216 of the horizontal wellbore 206.

To facilitate injection of the mixture, a first pump 212, coupled to the injection tube 210, is used. A heater 214, also coupled to the injection tube 210, is used to heat the mixture before it is injected into the wellbore 204. Different types of pumps 212 and heaters 214 that could be employed for the present invention would be known to a person skilled in the art. For instance, the heater 214 can be a direct fired heater and the first pump 212 can be a screw pump.

The mixture is heated to 150 to 180 degrees C. or any temperature that vaporises the water in the mixture into steam. The heated injection mixture may contain some water depending on steam quality.

The injection tube 210 may be insulated so as to minimize heat loss from the injection mixture as it travels down the injection tube 210. Insulated injection tubes are known and some have been described in U.S. Pat. No. 7,621,333 to Marchal. In some alternative embodiments, the injection tube 210 may also comprise a heating source (not shown), such as an electrical conductor, or an RF or microwave based heater, at the toe region 216 for vaporizing water injected with the hydrocarbon rather than vaporizing the water at surface, and for heating the injected hydrocarbon. Such an alternative involving injection of hydrocarbon and water, with downhole heating to produce heated hydrocarbon and steam, would comprise the steps of circulating and production as described otherwise herein. The skilled person will know of a number of commercially available heaters commonly employed in the hydrocarbon recovery industry that would be applicable, and further details are therefore not provided herein.

After injection into the toe region 216, the injection mixture is circulated, through the horizontal wellbore 206 annulus, towards a heel region 218 of the horizontal wellbore 206, allowing the injection mixture to increase the temperature, by conduction, of a portion of the hydrocarbon-containing reservoir 208. This results in the viscosity of the hydrocarbon within the reservoir 208 being reduced, allowing some of the reservoir hydrocarbon to flow from the reservoir 208 into the horizontal wellbore 206 along with reservoir water and mix with the injection mixture, including any condensed water derived from the steam in the injection mixture.

As discussed above, the injection mixture comprises steam. As the latent heat of steam is much larger than heated hydrocarbon, more heat can thus be delivered to the reservoir 208 than by injecting heated hydrocarbon alone. The injected hydrocarbon and steam mixture thus provides a better heat transfer mechanism, while at the same time less cubic meters of steam are necessary compared with conventional steam-based thermal recovery methods.

As shown in FIG. 2*a*, a production tube 220, provided inside the horizontal wellbore 206, is used for producing the injection mixture, including any condensed water derived from steam in the injection mixture, the hydrocarbon from the reservoir and any reservoir water that may be present. One end of the production tube 220 is coupled to the storage tank 202, while the other end of the production tube 220 terminates at the heel region 218 of the horizontal wellbore 206.

A second pump 222 is provided, coupled to the terminal end of the production tube 220 at the heel region 218 of the horizontal wellbore 206, for pumping the injection mixture (including condensed water) and the hydrocarbon (and water) from the reservoir 208 into the production tube 220 allowing them to be produced to the surface and into the storage tank 202.

As will be clear from in FIG. 2*a*, at least some of the fluids in the storage tank 202, that had been previously produced from the wellbore 204, can be re-injected back into the wellbore 204, via the process described above, allowing for thermal recovery of additional hydrocarbon housed in the reservoir 208.

The steps of injecting and producing occur at a flow rate that allows the injection mixture to circulate inside the horizontal wellbore while not entering into the reservoir to any significant degree. In the exemplary embodiment, the step of producing occurs at the same or a higher flow rate than that of the step of injecting. For one non-limiting example, injecting and producing may occur at a flow rate of 20 to 50 m3/d for a 1000 m long horizontal wellbore, although the skilled person will be able to determine other rates that may be appropriate for the conditions of the wellbore 206 and reservoir 208.

Figure 2B:
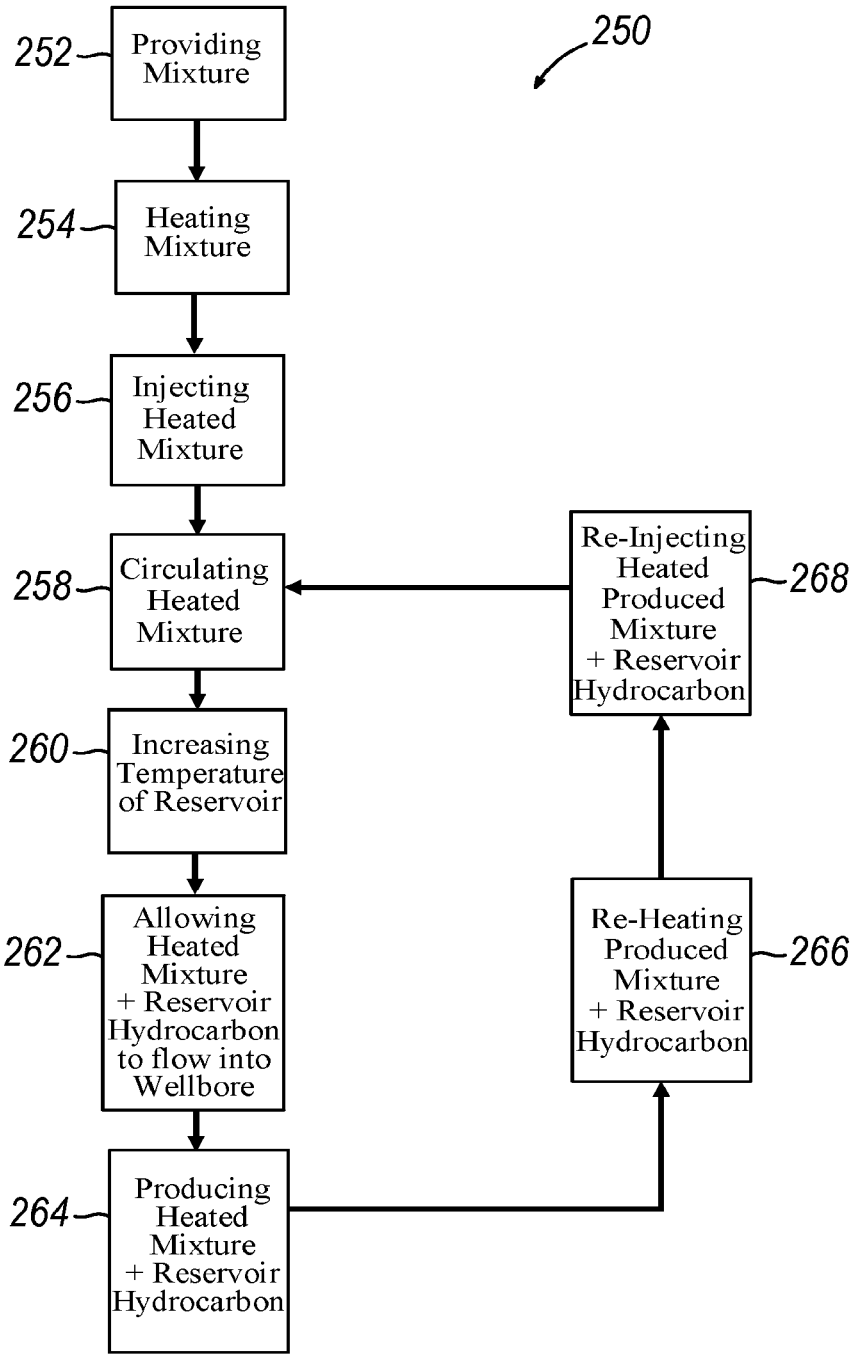
FIG. 2*b* is a flow chart illustrating a second exemplary embodiment.

Turning to FIG. 2*b*, a second embodiment of the present invention is illustrated. A method 250 is illustrated in the flowchart that allows a mixture comprising hydrocarbon and steam to be heated and injected into a horizontal wellbore that passes through a hydrocarbon-containing reservoir.

The first step 252 involves providing a mixture comprising hydrocarbon and water. In some exemplary embodiments, the mixture comprises between 1 to 50% by volume of water.

The mixture is then heated at step 254 to form a heated injection mixture comprising heated hydrocarbon and steam, and then injected at step 256 into a horizontal wellbore. Heating of the mixture at step 254 may occur by a variety of means known to a person skilled in the art. In some exemplary embodiments, the mixture is heated to 150 to 180 degrees C., or any temperature that is appropriate for the surface facilities and vaporises the water in the mixture into steam.

A pumping means could be employed for injection 256 of the injection mixture into the horizontal wellbore. Injection of the heated mixture occurs through an injection tube provided inside the horizontal wellbore. The injection tube terminates at a toe region of the horizontal wellbore.

After injection into the toe region, the heated mixture is circulated at step 258, through the horizontal wellbore annulus, towards a heel region of the horizontal wellbore. The heated mixture is allowed to increase the temperature of the reservoir, by conduction at step 260, and reduce the viscosity of the hydrocarbon within the reservoir.

This results in the viscosity of the hydrocarbon within the reservoir being reduced allowing some of the reservoir hydrocarbon to flow, at step 262, from the reservoir into the horizontal wellbore along with some reservoir water and mix with the injection mixture, including any condensed water derived from steam in the injection mixture.

The injection mixture (including any condensed water derived from steam in the injection mixture) and the hydrocarbon and water from the reservoir are then produced, at step 264, to surface. A production tube, provided inside the horizontal wellbore, is used for producing these fluids. One end of the production tube terminates at the surface, while the other end of the production tube terminates at the heel region of the horizontal wellbore. Another pumping means is employed for pumping these fluids into the production tube allowing them to be produced to the surface.

Some of the fluids thus produced to the surface are re-heated at step 266 and re-injected at step 268 back into the horizontal wellbore and allowed to circulate inside the horizontal wellbore causing thermal recovery of additional reservoir hydrocarbon housed in the reservoir. The steps of re-heating 266 and re-injecting 268 could occur multiple times allowing for thermal recovery of additional reservoir hydrocarbon housed in the reservoir. If an insufficient amount of reservoir water was previously produced from the wellbore, the injection mixture may comprise additional externally-sourced water.

The steps of injecting/re-injecting and producing occur at a flow rate that allows the injection mixture to circulate inside the horizontal wellbore while not entering into the reservoir to any significant extent. In some exemplary embodiments, the step of producing occurs at the same or a higher flow rate than that of the step of injecting. Injecting and producing may occur at a flow rate of 20 to 50 m3/d for a 1000 m long horizontal wellbore, or any other rate that is appropriate for the conditions of the wellbore and reservoir.

While the above description is with respect to a horizontal wellbore, it will be clear to those skilled in the art that the present invention may be applied with modifications to a vertical wellbore arrangement.

Figure 3A:
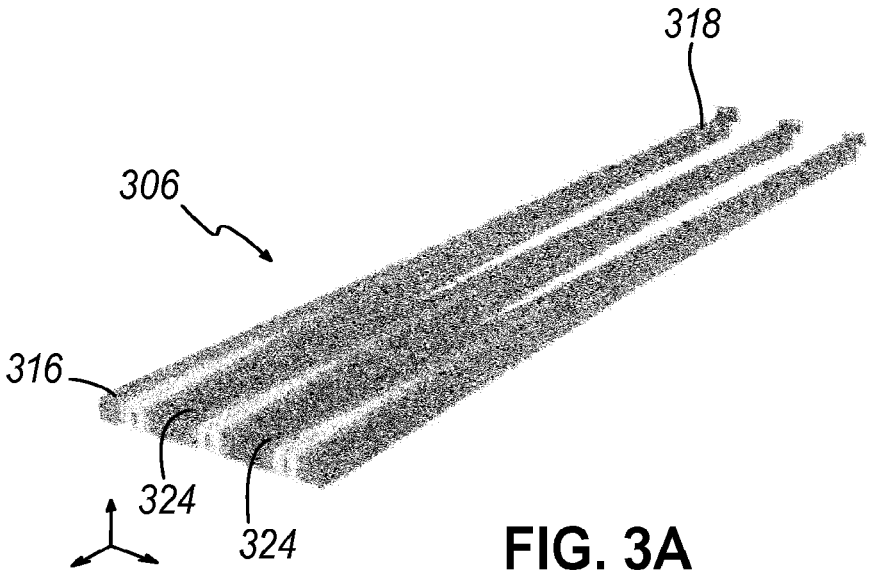
FIG. 3*a* is a perspective view of a plurality of horizontal wellbores illustrating a third exemplary embodiment of the present invention.

Turning to FIG. 3*a*, a plurality of horizontal wellbores illustrating a third embodiment of the present invention is shown. The method of the third embodiment is generally the same as that described for the first and second embodiments except that a plurality of horizontal wellbores 306 are employed.

The wellbores 306, shown in FIG. 3*a*, are horizontally adjacent to each other and are drilled in the same substantially parallel direction. After injection into the toe region 316 of each well, the injection mixture is circulated, while inside the horizontal wellbore 306, towards a heel region 318 of the horizontal wellbore 306, allowing the injection mixture to increase the temperature, by conduction, of a portion the hydrocarbon-containing reservoir. As can be seen by the temperature profile shown in FIG. 3*a*, the heated mixture in each wellbore 306 causes similar portions of the reservoir to increase in temperature. This can result in adjacent horizontal wellbores 306 competing for hydrocarbon production from the same hydrocarbon-containing regions 324 adjacent to the toe regions 316 of the horizontal wellbores 306.

Figure 3B:
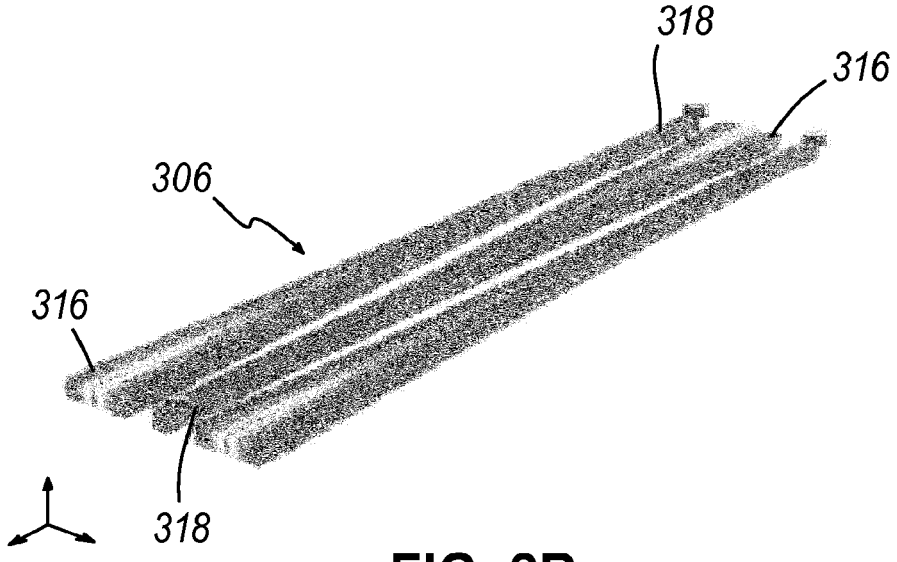
FIG. 3*b* is a perspective view of a plurality of horizontal wellbores with alternating orientations illustrating a fourth exemplary embodiment of the present invention.

Turning to FIG. 3*b*, a plurality of horizontal wellbores illustrating a fourth embodiment of the present invention is shown. The method of the fourth embodiment is the same as that described for the first and second embodiments except that a plurality of horizontal wellbores 306 are employed.

The wellbores 306, shown in FIG. 3*b*, are horizontally adjacent to each other, but unlike the well arrangement in FIG. 3*a* they are drilled in opposite substantially parallel directions from each other. Each of the substantially parallel wellbores is drilled in an alternating direction compared to that of an adjacent wellbore.

By orienting the wellbores 306 in this manner, there is less of a possibility that the heated mixture in each wellbore 306 can cause similar areas of the reservoir to increase in temperature, and thus overlapping production regions 324 are minimized, as illustrated in FIG. 3*b*.

Figure 4A:
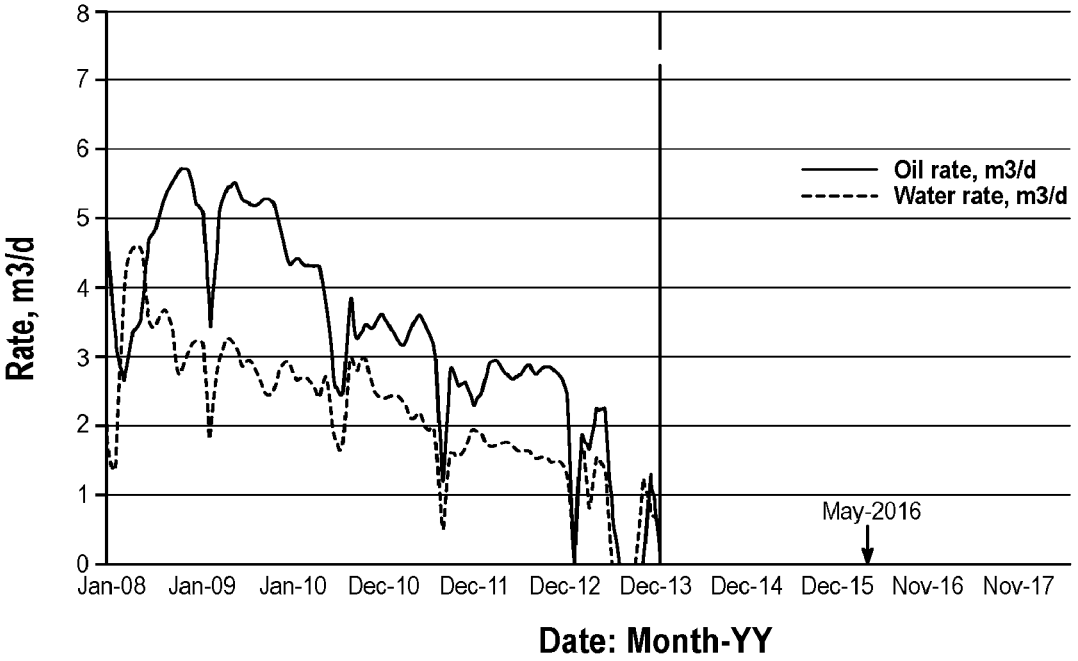
FIG. 4*a* is a graph illustrating the rate of hydrocarbon production over time during a field test, wherein the present invention is not employed.
Figure 4B:
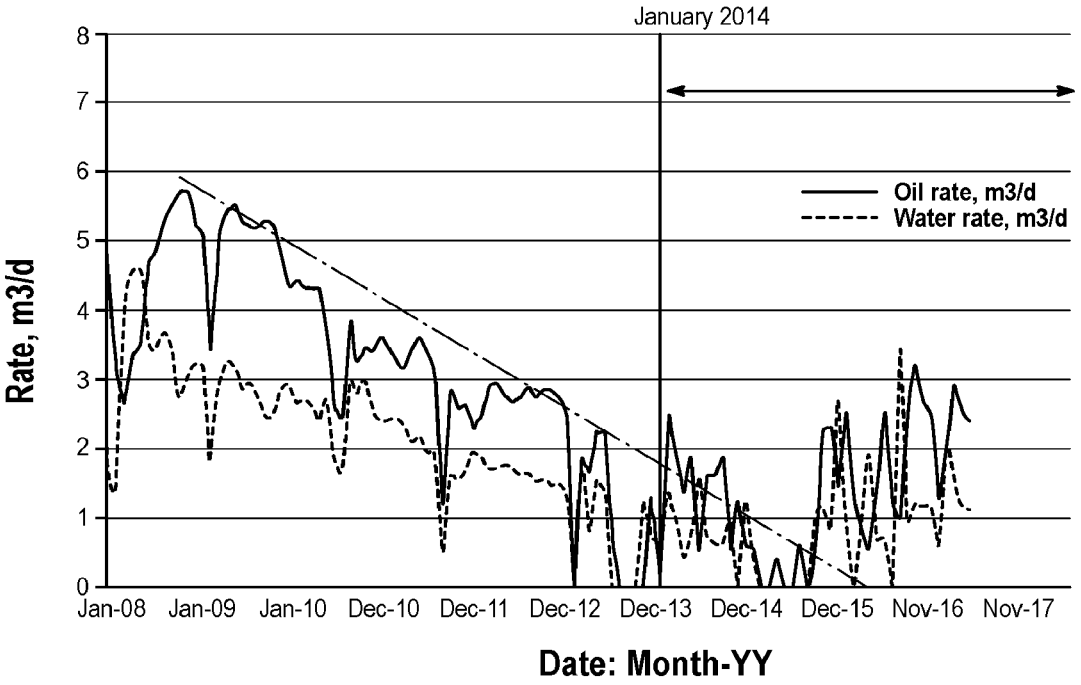
FIG. 4*b* is a graph illustrating the rate of hydrocarbon production over time during a field test, wherein an embodiment of the present invention is employed.

Turning to FIGS. 4*a* and 4*b*, graphs of the rate of hydrocarbon production over time are illustrated. As shown in FIG. 4*a*, field tests of an existing horizontal well suggest that a natural decline of primary production would have resulted in the well ceasing production by May 2016. However, when the method of the present invention was employed, as described above, starting in January 2014, it is shown in FIG. 4*b* that production increased and was maintained for a much longer time frame than was predicted for the situation where the present invention was not employed.

During these field tests, the injected mixtures comprised 10 to 20% produced water and 80 to 90% produced hydrocarbon. Flow rates were between 15 to 25 m3/d, and the injected mixtures had a temperature in the 150 to 180 degrees C. range at the wellhead. Water in the injected mixture was partially converted to steam due to heating. The amount of injected steam, from the produced water, facilitates the delivery of more heat to the reservoir due to the latent heat of steam.

EXAMPLE

A numerical simulation model was constructed using the industry-standard STARS modelling software of Computer Modelling Group Ltd. to illustrate the advantage of injecting water with hydrocarbon.

Figure 5:
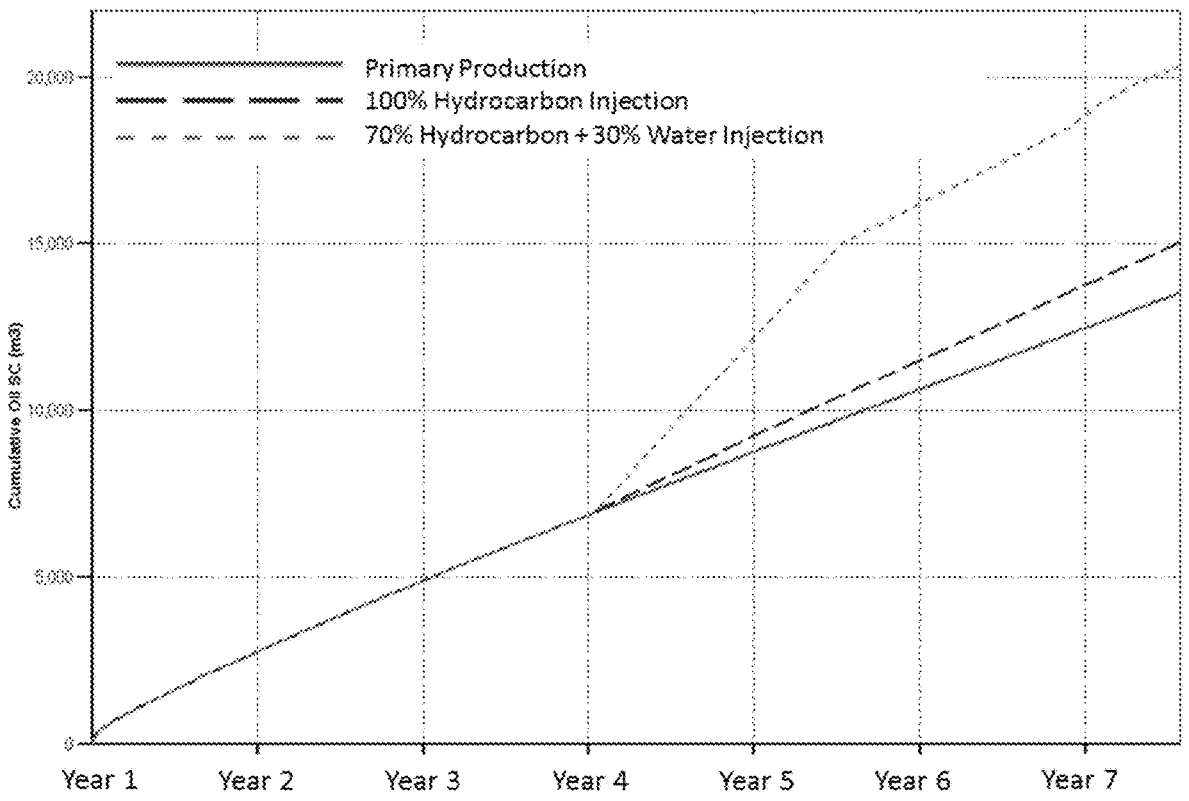
FIG. 5 is a graph showing the results of a simulation test illustrating the present invention.

The following parameters were used in the simulation:

Horizontal well length=1000 m
Formation thickness=5 m
Formation porosity=30%
Formation permeability=2 Darcy
Oil viscosity=15,000 cp
Total injection rate=50 m3/d
Hydrocarbon injection rate=35 m3/d
Water injection rate=15 m3/d
Injection temperature=210 degrees C.
Reservoir pressure=2000 kPa The simulation results are shown in FIG. 5, which illustrates the advantage of injecting a 30% water and 70% hydrocarbon mixture when compared with 100% hydrocarbon. In particular, it will be clear that over time the recovered reservoir hydrocarbon increases when compared to a method employing injection of hydrocarbon alone.

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to".

"connected", "coupled", or any variant thereof, means any connection or coupling, either direct or indirect, between two or more elements; the coupling or connection between the elements can be physical, logical, or a combination thereof "herein", "above", "below", and words of similar import, when used to describe this specification shall refer to this specification as a whole and not to any particular portions of this specification.

"or", in reference to a list of two or more items, covers all of the following interpretations of the word: any of the items in the list, all of the items in the list, and any combination of the items in the list.

the singular forms "a", "an" and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of methods and apparatus have been described herein for purposes of illustration. These are only examples. The technology provided herein can be applied to contexts other than the exemplary contexts described above. Many alterations, modifications, additions, omissions and permutations are possible within the practice of this invention. This invention includes variations on described embodiments that would be apparent to the skilled person, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

The foregoing is considered as illustrative only of the principles of the invention. The scope of the claims should not be limited by the exemplary embodiments set forth in the foregoing, but should be given the broadest interpretation consistent with the specification as a whole.

What is claimed is:

1. A thermal hydrocarbon recovery method for producing reservoir hydrocarbon from a reservoir, the method comprising the steps of:

mixing liquid hydrocarbon and water to form a mixture;

heating the mixture, at a surface, to form a heated injection mixture comprising heated hydrocarbon and steam; and injecting, from the surface, the heated injection mixture into at least one wellbore positioned inside the reservoir and circulating the heated injection mixture inside the at least one wellbore by producing to the surface the heated injection mixture;

wherein the circulating of the heated injection mixture inside the at least one wellbore allows the heated injection mixture to increase the temperature of the reservoir and thus reduce the viscosity of the reservoir hydrocarbon, convert at least some of the steam to condensed water, and allow the reservoir hydrocarbon and reservoir water to flow into the at least one wellbore and mix with the heated injection mixture; and wherein the step of producing to the surface the heated injection mixture comprises producing to the surface the condensed steam, the reservoir hydrocarbon and the reservoir water; and wherein the step of producing occurs at the same or a higher flow rate than that of the step of injecting such that the heated injection mixture circulates inside the at least one wellbore while not substantially exiting the at least one wellbore and not substantially entering into the reservoir.

2. The method of claim 1 wherein the hydrocarbon and the water of the mixture comprise produced hydrocarbon and produced water, respectively, that are produced from a hydrocarbon recovery process.

3. The method of claim 2 wherein the produced hydrocarbon and the produced water were initially produced from the at least one wellbore.

4. The method of claim 2 wherein the water used to form the mixture further comprises additional externally-sourced water.

5. The method of claim 1 wherein the mixture comprises 1 to 50% by volume of water.

6. The method of claim 1 wherein an injection tube, provided inside the at least one wellbore, is used for injecting the heated injection mixture into the at least one wellbore.

7. The method of claim 6 wherein the injection tube is insulated.

8. The method of claim 1 wherein a pump is provided for the step of producing.

9. The method of claim 1 wherein a production tube, provided inside the at least one wellbore, is used for producing the heated injection mixture, the condensed steam, the reservoir hydrocarbon and the reservoir water.

10. The method of claim 9 wherein a pump is provided, engaged with the production tube, for pumping the heated injection mixture, the condensed steam, the reservoir hydrocarbon and the reservoir water into the production tube allowing the heated injection mixture, the condensed steam, the reservoir hydrocarbon and the reservoir water to be produced to the surface.

11. The method of claim 1 wherein the heated injection mixture is injected into a toe region of the at least one horizontal wellbore.

12. The method of claim 11 wherein an injection tube, provided inside the at least one horizontal wellbore, is used for injecting the heated injection mixture into the toe region of the at least one horizontal wellbore.

13. The method of claim 12 wherein the injection tube is insulated.

14. The method of claim 1 wherein a pump is provided for the step of producing.

15. The method of claim 1 wherein the heated injection mixture, the condensed steam, the reservoir hydrocarbon and the reservoir water are produced from a heel region of the at least one horizontal wellbore.

16. The method of claim 1 wherein a production tube, provided inside the at least one horizontal wellbore, is used for producing the heated injection mixture, the condensed steam, the reservoir hydrocarbon and the reservoir water.

17. The method of claim 16 wherein a pump is provided, engaged with the production tube, for pumping the heated injection mixture, the condensed steam, the reservoir hydrocarbon and the reservoir water into the production tube allowing the heated injection mixture, the condensed steam, the reservoir hydrocarbon and the reservoir water to be produced to the surface.

18. The method of claim 16 wherein the production tube terminates at a heel portion of the at least one horizontal wellbore.

19. The method of claim 1 wherein the at least one horizontal wellbore comprises a plurality of substantially parallel horizontal wellbores.

20. The method of claim 19 wherein each of the plurality of substantially parallel horizontal wellbores is drilled in an alternating direction from an adjacent horizontal wellbore from the plurality of substantially parallel horizontal wellbores.

21. A thermal hydrocarbon recovery method for producing reservoir hydrocarbon from a reservoir, the method comprising the steps of:

mixing liquid hydrocarbon and water to form a mixture;

heating the mixture, at a surface, to form a heated injection mixture comprising heated hydrocarbon and steam; and injecting, from the surface, the heated injection mixture into at least one horizontal wellbore positioned inside the reservoir, wherein an injection tube, provided inside the at least one horizontal wellbore and terminating at a toe region of the at least one horizontal wellbore, is used for injecting the heated injection mixture into the toe region of the at least one horizontal wellbore, and circulating the heated injection mixture inside the at least one horizontal wellbore by producing to the surface the heated injection mixture through an annulus of the at least one horizontal wellbore, towards a heel region of the at least one horizontal wellbore, inside the at least one horizontal wellbore, wherein a production tube, provided inside the at least one horizontal wellbore and terminating at the heel portion of the at least one horizontal wellbore, is used for producing the heated injection mixture;

wherein the circulating of the heated injection mixture inside the at least one wellbore allows the heated injection mixture to increase the temperature of the reservoir and thus reduce the viscosity of the reservoir hydrocarbon, convert at least some of the steam to condensed water, and the reservoir hydrocarbon and reservoir water to flow into the at least one horizontal wellbore and mix with the heated injection mixture; and wherein the step of producing to the surface the heated injection mixture comprises producing to the surface the condensed steam, the reservoir hydrocarbon and the reservoir water through the production tube; and wherein the step of producing occurs at the same or a higher flow rate than that of the step of injecting.

22. A method for producing reservoir hydrocarbon from a reservoir comprising:

a) using surface-located equipment to mix liquid hydrocarbon and water to form a mixture and heat the mixture to form a heated injection mixture comprising heated hydrocarbon and steam;

b) injecting the heated injection mixture into at least one horizontal wellbore that extends inside the reservoir; and c) circulating the heated injection mixture inside the at least one horizontal wellbore by producing fluids from the at least one horizontal wellbore to the surface;

wherein the circulating of c) is configured to i) increase temperature of the reservoir and reduce viscosity of the reservoir hydrocarbon, ii) convert at least some of the steam of the heated injection mixture to condensed water, and iii) allow at least the reservoir hydrocarbon to flow into the at least one horizontal wellbore;

wherein the producing of c) is configured to produce the heated injection mixture, the condensed water, and the reservoir hydrocarbon that flows into the at least one horizontal wellbore to the surface; and wherein the producing of c) occurs at a first flow rate, the injecting of b) occurs at a second flow rate, and wherein the first flow rate is the same or greater than the second flow rate such that the heated injection mixture circulates inside the at least one horizontal wellbore while not substantially exiting the at least one horizontal wellbore and not substantially entering into the reservoir.

23. The method of claim 22, wherein:

the circulating of c) is further configured to allow reservoir water to flow into the at least one horizontal wellbore; and wherein the producing of c) is configured to produce the reservoir water that flows into the at least one horizontal wellbore to the surface.

24. The method of claim 22, wherein:

the liquid hydrocarbon and the water that are mixed in a) comprise produced hydrocarbon and produced water, respectively, that are produced by a hydrocarbon recovery process.

25. The method of claim 24, wherein:

the produced hydrocarbon and the produced water are initially produced from the at least one horizontal wellbore.

26. The method of claim 24, wherein:

the water that is mixed with liquid hydrocarbon in a) further comprises additional externally-sourced water.

27. The method of claim 22, wherein:

the injecting of b) employs injection tubing that extends inside the at least one horizontal wellbore; and the producing of c) employs production tubing that extends inside the at least one horizontal wellbore.

28. The method of claim 22, wherein:

the producing of c) employs a pump disposed within the at least one horizontal wellbore.

29. The method of claim 22, wherein:

the surface-located equipment of a) includes a heater; and the injecting of b) uses a surface-located pump.

* * * * *